US010249989B2

(12) United States Patent
Luk et al.

(10) Patent No.: US 10,249,989 B2
(45) Date of Patent: Apr. 2, 2019

(54) MITIGATION OF CONNECTOR STUB RESONANCE

(71) Applicant: Hirose Electric Co., Ltd., Shinagawa-ku, Tokyo (JP)

(72) Inventors: Clement Luk, San Jose, CA (US); Jeremy Buan, San Jose, CA (US); Tadashi Ohshida, San Jose, CA (US); Ching-Chao Huang, San Jose, CA (US)

(73) Assignee: HIROSE ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 15/878,624

(22) Filed: Jan. 24, 2018

(65) Prior Publication Data

US 2018/0261961 A1 Sep. 13, 2018

Related U.S. Application Data

(60) Provisional application No. 62/469,469, filed on Mar. 9, 2017.

(51) Int. Cl.

| | |
|---|---|
| ***H01R 13/64*** | (2006.01) |
| ***H01R 13/6474*** | (2011.01) |
| ***H01R 13/22*** | (2006.01) |
| ***H01R 43/16*** | (2006.01) |

(52) U.S. Cl.
CPC ..... *H01R 13/6474* (2013.01); *H01R 13/22* (2013.01); *H01R 43/16* (2013.01)

(58) Field of Classification Search
CPC ..... H01R 13/6474
See application file for complete search history.

(56) References Cited

U.S. PATENT DOCUMENTS

| | | | | |
|---|---|---|---|---|
| 2010/0045408 | A1* | 2/2010 | Huang | H01R 13/719 333/245 |
| 2010/0184307 | A1* | 7/2010 | Arai | H04M 1/76 439/65 |
| 2013/0328645 | A1 | 12/2013 | Na et al. | |
| 2014/0167886 | A1 | 6/2014 | Na et al. | |
| 2015/0357760 | A1* | 12/2015 | Aihara | H05K 1/115 439/55 |
| 2017/0207562 | A1 | 7/2017 | Gailus et al. | |

* cited by examiner

*Primary Examiner* — Ross N Gushi
(74) *Attorney, Agent, or Firm* — Procopio, Cory, Hargreaves & Savitch LLP

(57) ABSTRACT

Example implementations described herein are directed to a method and apparatus for improving insertion loss of connector stub and thereby increasing a system's signal bandwidth. This technique shapes the connector stub in a specific way to shift its resonant frequency higher while having equal or better electrical performance below the original resonant frequency.

14 Claims, 9 Drawing Sheets

MITIGATION OF CONNECTOR STUB RESONANCE

CROSS REFERENCE TO RELATED APPLICATIONS

This regular U.S. patent application is based on and claims the benefit of priority under 35 U.S.C. 119 from provisional U.S. patent application Ser. No. 62/469,469, filed on Mar. 9, 2017, the entire disclosure of which is incorporated by reference herein.

BACKGROUND

Field

This invention relates generally to connector stub resonance, and more specifically, to methods and apparatuses for mitigating the adverse effect of connector stub resonance in signal transmission.

Related Art

The connector constitutes one of the largest discontinuities in a chip-to-chip communication channel. In related art implementations, the connector stub is utilized for mechanical reliability but is detrimental for high-speed signal transmission. US Patent Applications US 2013/0328645A1 and US 2014/0167886A1 shape the plating stub, commonly found in wire-bond electronic package, into multiple segments of different widths in order to shift the stub's resonant frequency higher. These applications focus on increasing the resonant frequency of the plating stub.

SUMMARY

The present invention is directed to shaping or determining modifications for the connector stub to provide desirable input impedance at the frequency of interest so that the system performance can be improved from direct current (DC) to beyond the original resonant frequency.

In one aspect of the present invention, the stub is designed to have larger width at the contact point and smaller width towards the open end. Compared to the original constant-width design, this new design alters the stub's input impedance and shifts the resonant frequency higher.

In another aspect of the present invention, the total capacitance of the new varying-width stub design is made to be no larger than the total capacitance of original constant-width stub design, so that the new design gives an electrical performance that is equal to or better than the original design at frequencies below the original resonant frequency.

Aspects of the present disclosure include systems and methods for mitigating connector stub resonance, which can involve shifting the resonant frequency of the connector stub higher, and perturbing the characteristic impedance of the connector stub such that its input impedance becomes capacitive at the original resonant frequency. Such a connector stub can involve a plurality of segments with each segment having different width or impedance to attain the desired (e.g. low-then-high) impedance structure. The connector stub may also involve a continuously shaped structure to attain the desired (low-then-high) impedance structure. The reshaped connector stub can have a total capacitance that is the same as or less than the total capacitance of the original stub design. Further, the reshaped connector stub has total area that is the same as or less than the total area of the original stub.

Aspects of the present disclosure include a connector, which can involve a connector plug. The connector plug can include a connector stub configured to engage with a receptacle, the connector stub comprising a first portion and a second portion, the first portion configured to be in closer proximity to an entrance of the receptacle than the second portion when the connector stub engages the receptacle; wherein the first portion has a smaller impedance than the second portion, wherein at least one of a capacitance of the connector stub and total area of the connector stub is made to be equal to or less than a connector stub formed with two first portions.

BRIEF DESCRIPTION OF THE DRAWINGS

The accompanying drawings, which are incorporated in and constitute a part of this specification exemplify the embodiments of the present invention and, together with the description, serve to explain and illustrate principles of the inventive technique. Specifically:

FIG. 1(*b*) illustrates an example of insertion loss of a connector with a stub.

DETAILED DESCRIPTION

Figure 1A:
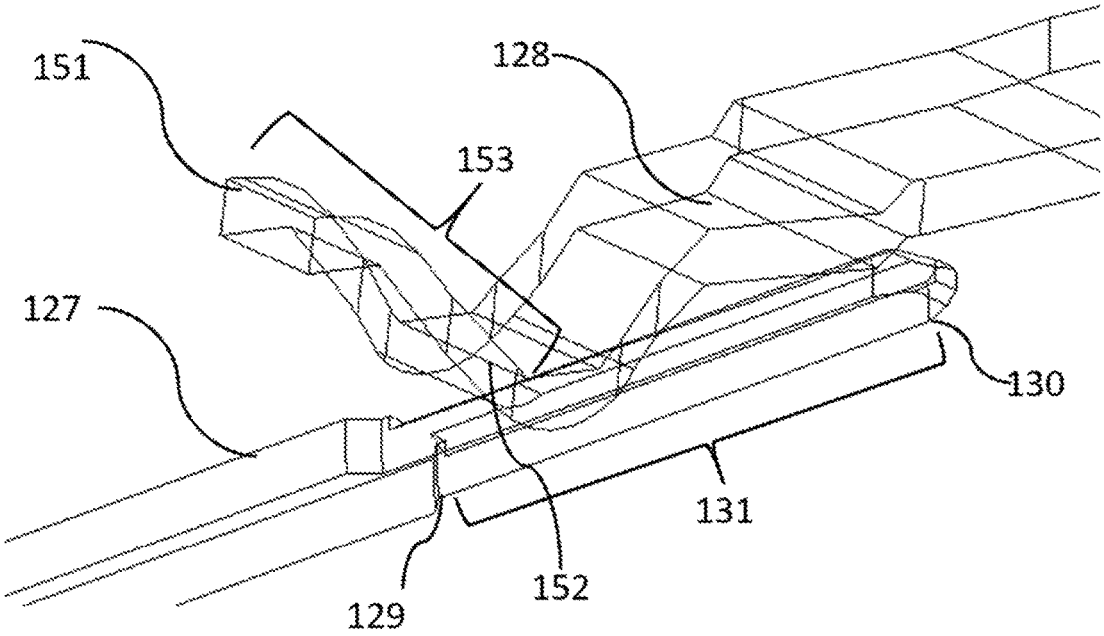
FIG. 1(*a*) illustrates an example implementation of a connector with a non-varying-impedance stub.

The following detailed description provides further details of the figures and example implementations of the present application. Reference numerals and descriptions of redundant elements between figures are omitted for clarity. Terms used throughout the description are provided as examples and are not intended to be limiting. Example implementations described herein may be used singularly, or in combination other example implementations described herein, or with any other desired implementation.

In a high-speed system, it is crucial to increase the signal bandwidth to higher frequency. A chip-to-chip communication channel can include interconnects such as electronic packages, vias, Printed Circuit Board (PCB) traces, connectors and cables where the signal path may encounter stubs at various locations (e.g., connector contacts). These stubs result in resonance at frequencies where each stub length becomes equal to the multiples of quarter wavelength. Resonance can limit the highest data rate at which a digital system can operate.

Example implementations described herein can involve methods for mitigating connector stub resonance. As described herein, such methods can include modifying an original connector stub design by shifting resonant frequency of the connector stub to be higher; and modifying the characteristic impedance of the connector stub such that input impedance of the connector stub becomes capacitive at the original resonant frequency as described in detail of FIG. 3.

In example implementations, the connector stub can be divided into a plurality of segments (e.g., sections, portions, etc.), wherein at least one of the plurality of segments has a different width or impedance than another one of the plurality of segments as illustrated in examples from FIGS. 8 to 11.

In example implementations, the connector stub can be manufactured or modified from an original connector stub to have a continuously shaped structure having a low-then-high impedance structure from a plug portion of the connector stub to an end of the connector stub as illustrated in examples from FIGS. 8 to 11.

Figure 6:
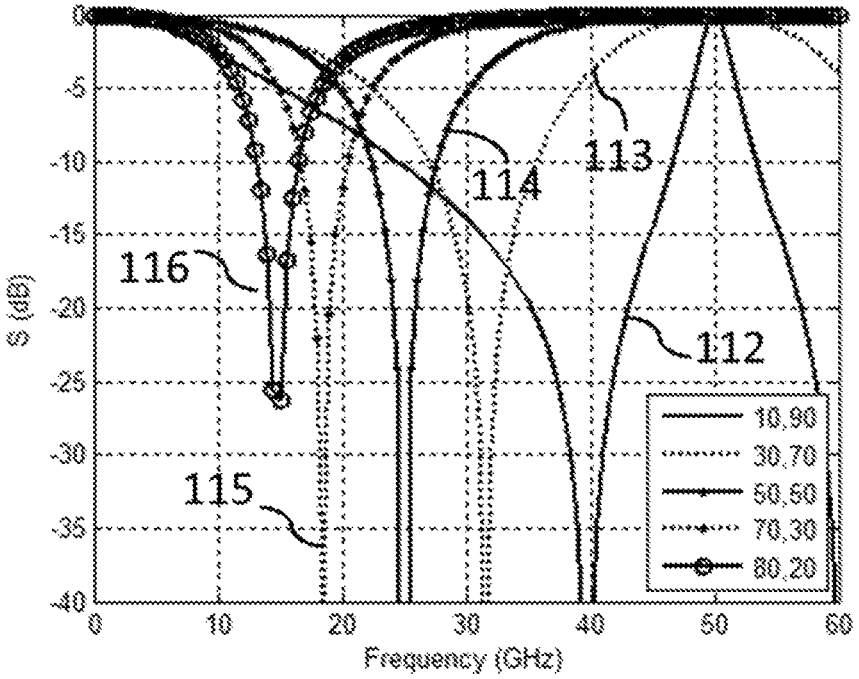
FIG. 6 illustrates the insertion loss with various combinations of Z1 and Z2 as depicted in FIG. 5.
Figure 7:
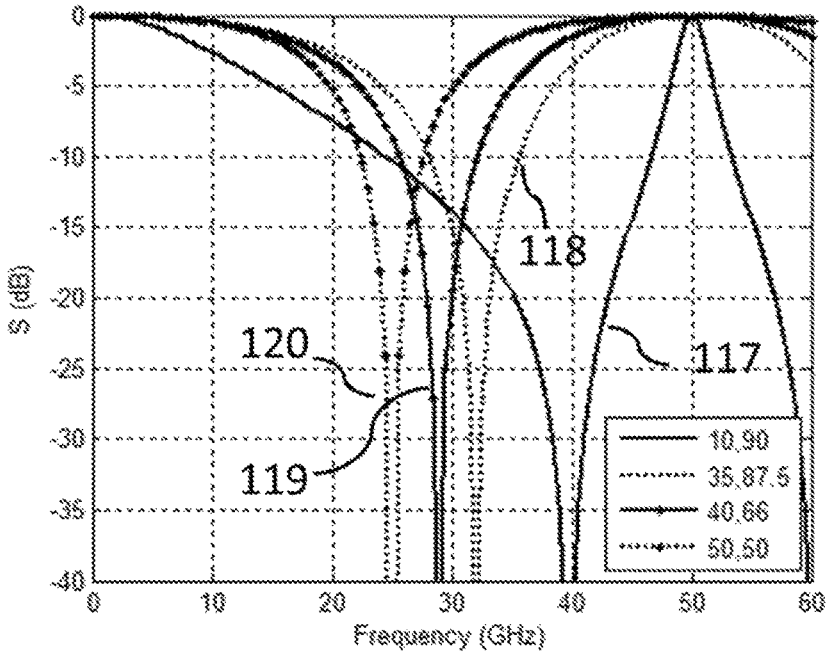
FIG. 7 illustrates examples of insertion loss with various combinations of Z1 and Z2 from FIG. 5.

In example implementations, the connector stub can be manufactured or reshaped from the original connector stub such that the connector stub has a total capacitance that is equal to or less than the total capacitance of the original stub as described with respect to FIGS. 6 and 7.

In example implementations, the connector stub can be manufactured or reshaped from the original connector stub such that the connector stub has a total area that is equal to or less than the total area of the original stub as illustrated in examples from FIGS. 8 to 11.

Example implementations can also involve a connector plug or a connector receptacle, which can involve a connector stub reshaped from an original connector stub, the connector stub configured to engage with a receptacle, the connector stub involving a first section and a second section, the first section configured to be in closer proximity to an entrance of the receptacle than the second section when the connector stub engages the receptacle, the second section disposed towards a plug end of the connector plug; wherein the first section has a smaller impedance than the second section, wherein at least one of: a) capacitance of the connector stub, and b) total area of the connector stub is made to be equal to or less than the original connector stub as illustrated in the examples of FIGS. 8 to 11.

In the subsequent paragraphs, the "connector stub" refers to connector plug stub. Nevertheless, the method of mitigation of connector stub resonance applies to a connector receptacle stub as well as a connector plug stub.

Figure 1B:
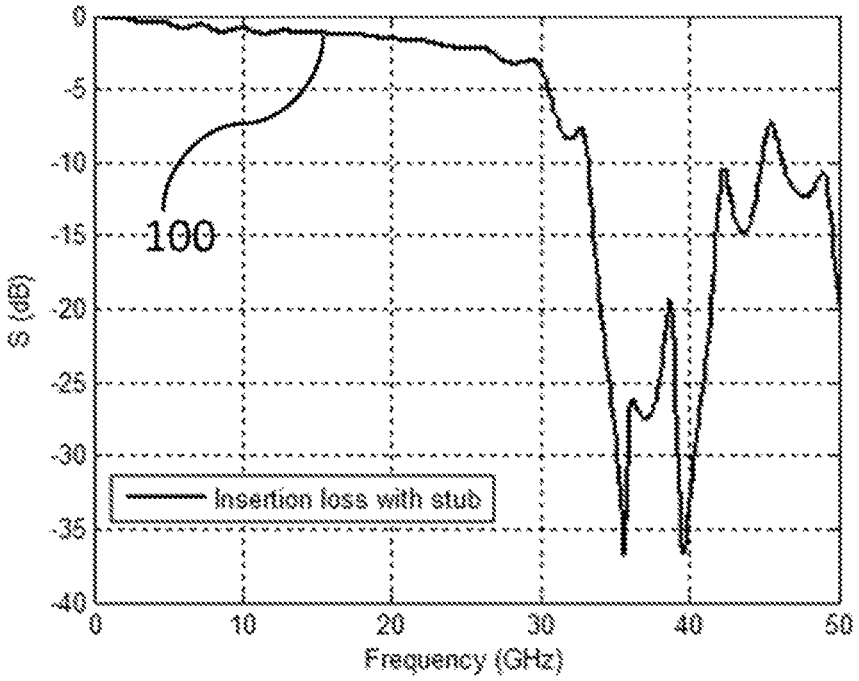

FIG. 1(*a*) illustrates an example implementation of a connector with a non-varying-impedance stub. 127 is the plug of a connector. 128 is the receptacle of a connector. 129 is the section with the same width as 130. Collectively, section 129 to 130 of the same width forms the connector plug stub 131. 151 is the section with the same width as 152. Collectively, section 151 to 152 of the same width forms the receptacle stub 153. FIG. 1(*b*) illustrates an example of insertion loss of a connector with a stub, and is an example of the insertion loss of FIG. 1(*a*). 100 shows that resonance occurs at around 35 GHz, as illustrated by the dip around 35 GHz to 40 GHz.

Figure 2:
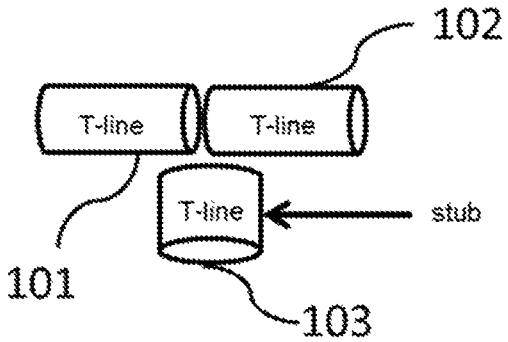
FIG. 2 illustrates an example electrical model of a connector stub.

FIG. 2 illustrates an example electrical model of a connector stub. Specifically, FIG. 2 illustrates the example electrical model of the connector of FIG. 1(*a*). 101 and 102 are both lossless transmission lines. Transmission line 101 connects to transmission line 102. 103 is a lossless transmission line with one end connecting to both 101 and 102 and the other end being left open (i.e., not connected).

A constant-width stub can be modeled by a transmission line with its input impedance ($Z_1$) given by $$Z_{in}=-jZ_0 \cot \beta l$$

where $Z_0$ is characteristic impedance, $\beta$ is propagation constant and l is length.

As illustrated in FIGS. 1(*a*) and 1(*b*), a connector with a non-varying impedance stub can cause problems in a high-speed signal environment that may utilize such frequencies in transmission. Example implementations are therefore directed to shifting the resonance frequency higher so that the connector and stub can facilitate higher frequency transmission while maintaining a desired signal integrity level.

Figure 3:
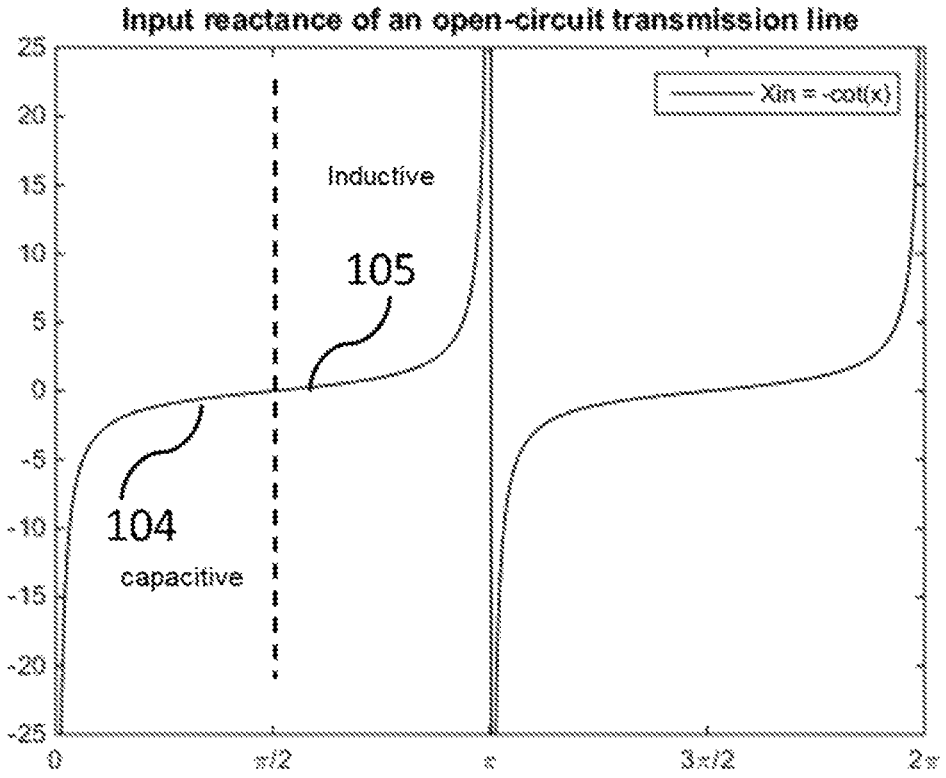
FIG. 3 illustrates an example input reactance of an open-circuit transmission line.

FIG. 3 illustrates an example input reactance of an open-circuit transmission line. The graph depicts $Z_{in}=-\cot(x)$ where x is the length of stub normalized by wavelength. At 104, the input reactance is negative, which corresponds to capacitive effect. At 105, the input reactance is positive, which corresponds to inductive effect. When x is $\pi/2$, the input reactance is zero.

Specifically, FIG. 3 illustrates the input impedance as a function of frequency where the first resonance occurs at $\beta l=\pi/2$. Note that when $\beta l<\pi/2$, the input reactance is negative (i.e., capacitive) and when $\pi/2<\beta l<\pi$, the input reactance is positive (i.e., inductive).

As illustrated in FIG. 3, the example implementations of the present disclosure are based on the idea that if the input reactance at original resonant frequency can be made negative instead of zero, then the resonant frequency will be shifted higher. The example implementations described herein are directed to perturbing the stub impedance in such a way that the input reactance appears capacitive at the original resonant frequency. As illustrated in the following examples, the shifting of resonant frequency can be achieved with reshaping of the connector stub based on the impedance, total area, capacitance, and so on. Further, different materials can be utilized in the connector stub to shift the resonant frequency by affecting the impedance or capacitance of the connector stub.

Figure 4:
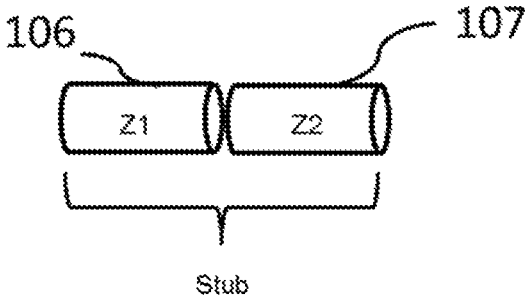
FIG. 4 illustrates an example model of a connector stub by utilizing two sections of transmission lines, in accordance with an example implementation.

FIG. 4 illustrates an example model of a connector stub by utilizing two sections of transmission lines, in accordance with an example implementation. Specifically, 106 is the first section of impedance Z1 and 107 is the second section of impedance Z2. In example implementations as described herein, it is possible to treat the connector stub as a plurality of segments or sections, with differing impedance at each of the segments or sections.

Figure 5:
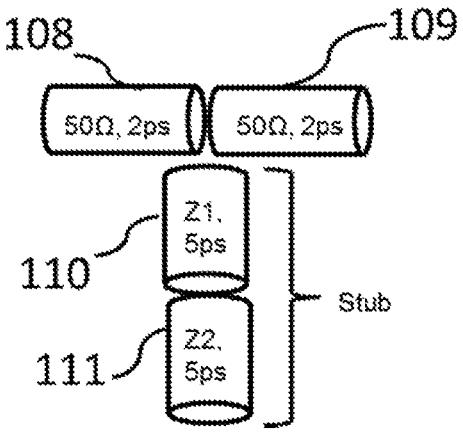
FIG. 5 illustrates an example model of a shaped connector stub by modeling the connector stub as two transmission lines, in accordance with an example implementation.

FIG. 5 illustrates an example model of a connector stub by utilizing two sections of transmission lines and modeling the connector stub as two transmission lines, in accordance with an example implementation. Specifically, FIG. 5 illustrates an example involving two 50 ohm lossless transmission lines 108 and 109 with 2 ps delay. The transmission lines 110 and 111 form the stub. Transmission line 110 is a 5 ps lossless transmission line with Z1 impedance and transmission line 111 is another 5 ps lossless transmission line with Z2 impedance.

The input impedance of a two-section stub can be written as $$Z_{in} = Z_1 \frac{-jZ_2\cot\beta_2 l_2 + jZ_1\tan\beta_1 l_i}{Z_1 + Z_2\cot\beta_2 l_2\tan\beta_1 l_1}$$

where $Z_k$ is characteristic impedance, $\beta_k$ is propagation constant and $l_k$ is length of each section (k=1,2). If $\beta_1 l_1=\beta_2 l_2=X$, then $$Z_{in} = jZ_1 \frac{Z_1\tan X - Z_2\cot X}{Z_1 + Z_2}$$

which is reduced to $$Z_{in} = jZ_1 \frac{Z_1 - Z_2}{Z_1 + Z_2}$$

at the first original resonant frequency when $$\beta_1 l_1 + \beta_2 l_2 = \frac{\pi}{2}.$$

As illustrated from the above input impedance equations, in order to have negative input reactance, Z1 must be made less than Z2 (i.e. Z1<Z2).

FIG. 6 illustrates an example of insertion loss for the model of FIG. 5 by varying the impedance of Z1, 110, and Z2, 111. Specifically, graph line 112 corresponds to the stub with Z1 equal to 10 ohm and Z2 equal to 90 ohm. Graph line 113 corresponds to the stub with Z1 equal to 30 ohm and Z2 equal to 70 ohm. Graph line 114 corresponds to the stub with Z1 equal to 50 ohm and Z2 equal to 50 ohm. Graph line 115 corresponds to the stub with Z1 equal to 70 ohm and Z2 equal to 30 ohm. Graph line 116 corresponds to the stub with Z1 equal to 80 ohm and Z2 equal to 20 ohm. The legend of FIG. 6 illustrates Z1 and Z2 in ohm. The base case 114 corresponds to a constant-width stub with Z1=Z2=50 ohm. Graph lines 112 and 113 shift the resonant frequency higher because Z1<Z2. Conversely, 115 and 116 shift the resonant frequency lower because Z1>Z2.

Note that graph line 112 in FIG. 6 shifts the resonant frequency higher, but at the expense of larger insertion loss (i.e. less transmission) at lower frequencies. To ensure that the new stub retains or improves on the low-frequency response of the original stub, the new stub is designed to have a total capacitance that is equal to or less than the total capacitance of the original stub, or approximately:

$$\frac{t_1 + t_2}{Z_0} \geq \frac{t_1}{Z_1} + \frac{t_2}{Z_2}$$

where $t_k$ is propagation delay of each section (k=1,2). Let $t_1=t_2$, $Z_1=xZ_0$ and $Z_2=\rho Z_1$, then $$\rho \geq \frac{1}{2x-1} > 1$$

-continued or $$\frac{1}{2} < x < 1$$

For the total capacitance to be equal to or less than the original stub total capacitance, the first section stub impedance Z1 and second section stub impedance Z2 must satisfy the conditions as described above.

FIG. 7 illustrates examples of insertion loss with various combinations of Z1 and Z2 from FIG. 5. Specifically, graph line 117 corresponds to the stub with Z1 equal to 10 ohm and Z2 equal to 90 ohm. Graph line 118 corresponds to the stub with Z1 equal to 35 ohm and Z2 equal to 87.5 ohm. Graph line 119 corresponds to the stub with Z1 equal to 40 ohm and Z2 equal to 66 ohm. Graph line 120 corresponds to the stub with Z1 equal to 50 ohm and Z2 equal to 50 ohm.

In FIG. 7, both graph lines 118 and 117 satisfy above design equations for capacitance because graph line 118 (with Z1=35 ohm and Z2=87.5 ohm) gives x=0.7 and p=0.4, and graph line 117 (with Z1=40 ohm and Z2=66 ohm) gives x=0.8 and p=0.6.

Figure 8A:
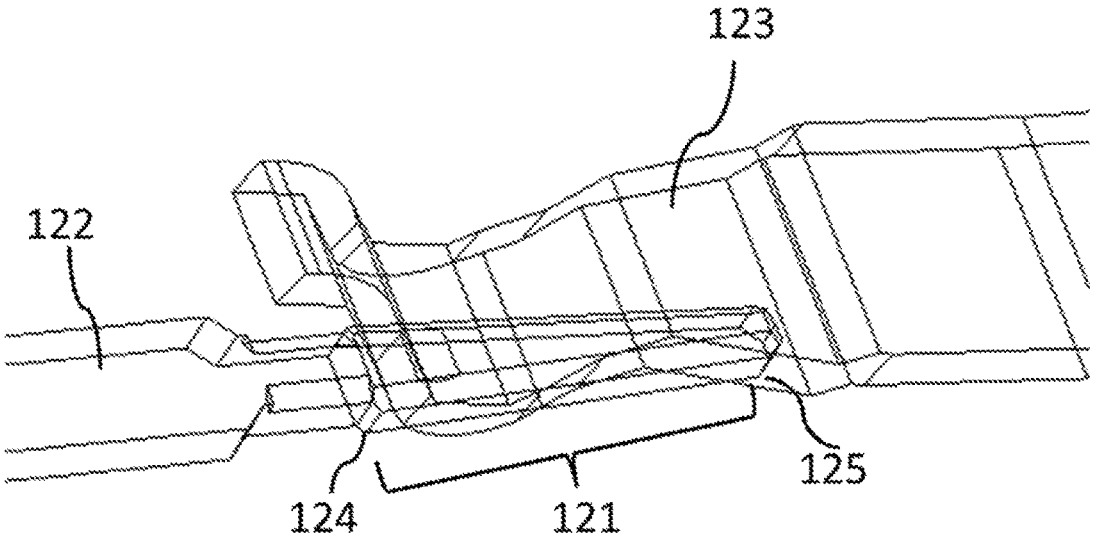
FIGS. 8(*a*) and 8(*b*) illustrate an example implementation of a connector with stub, in accordance with an example implementation.
Figure 8B:
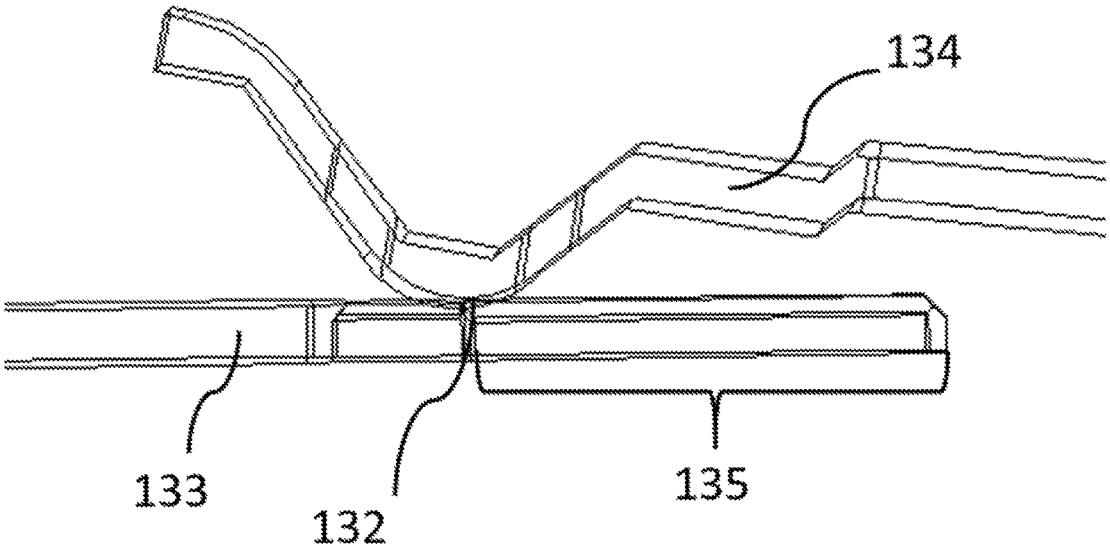

FIG. 8(*a*) illustrates an example implementation of a connector with stub, in accordance with an example implementation. 122 is the plug of a connector. Specifically, FIG. 8(*a*) illustrates an example of a varying-impedance connector stub design, in accordance with an example implementation. 123 is the receptacle of a connector. 124 is the section with larger width for low impedance. 125 is the section with smaller width for high impedance. Collectively, low impedance section 124 to high impedance section 125 forms the connector stub 121. Accordingly, the varying-impedance connector stub has an area that is no larger than the original connector stub, which satisfies the above equations. FIG. 8(*b*) depicts the side view of the connector with stub of FIG. 8(*a*). 133 is the plug of a connector. 134 is the receptacle of a connector. 132 is the contact point between 133 and 134. 135 depicts the side view of the connector stub.

As illustrated in FIGS. 8(*a*) and 8(*b*) the low impedance to high impedance structure can be achieved with a larger width towards the plug of the connector at 124 and a smaller width towards the end of the connector stub configured to insert into the receptacle of the connector as shown at 125.

Figure 9:
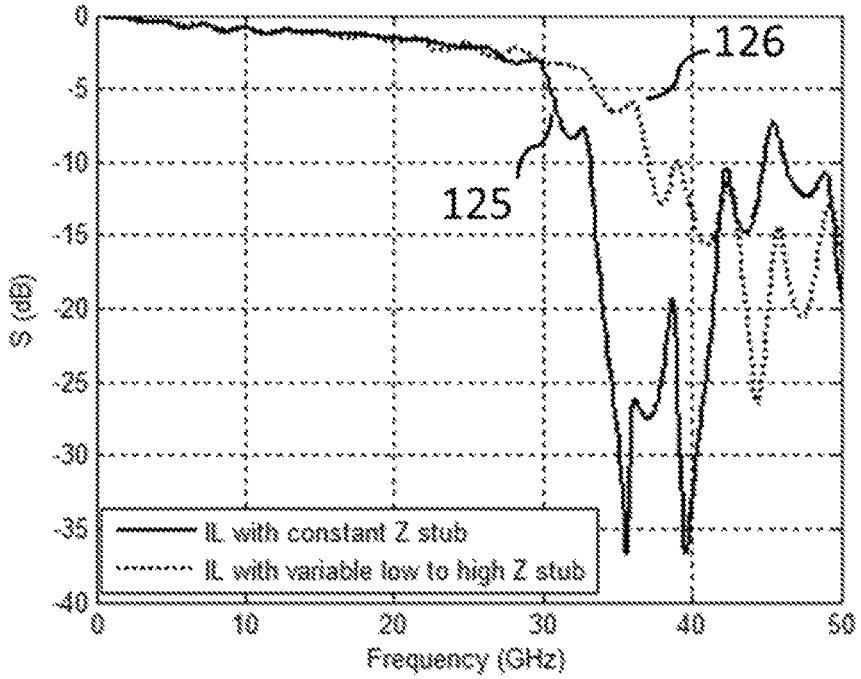
FIG. 9 illustrates an insertion loss of a connector with a stub, in accordance with an example implementation.

FIG. 9 illustrates an insertion loss of a connector with a stub, in accordance with an example implementation. Specifically, FIG. 9 illustrates an example of the improvement to insertion loss based on the construction of stub designs in accordance with an example implementation. Graph line 125 corresponds to the insertion loss with constant-impedance stub. Graph line 126 corresponds to the insertion loss with a varying impedance stub, as depicted in FIG. 8(*a*). As illustrated by graph line 126, the varying impedance stub in accordance with the example implementations described above can result in reduced insertion loss and also a shift of the resonance frequency to a higher frequency.

In example implementations described herein, there may also be other configurations to obtain the low-then-high impedance structure in the singular or in the aggregate in accordance with the desired implementation while maintaining a varying-impedance connector stub design. Depending on the desired implementation and the desired resonance frequency shift, an aggregation or a plurality of low-then-high impedance structures can be utilized for each section of the connector stub as illustrated in the following examples.

Figure 10:
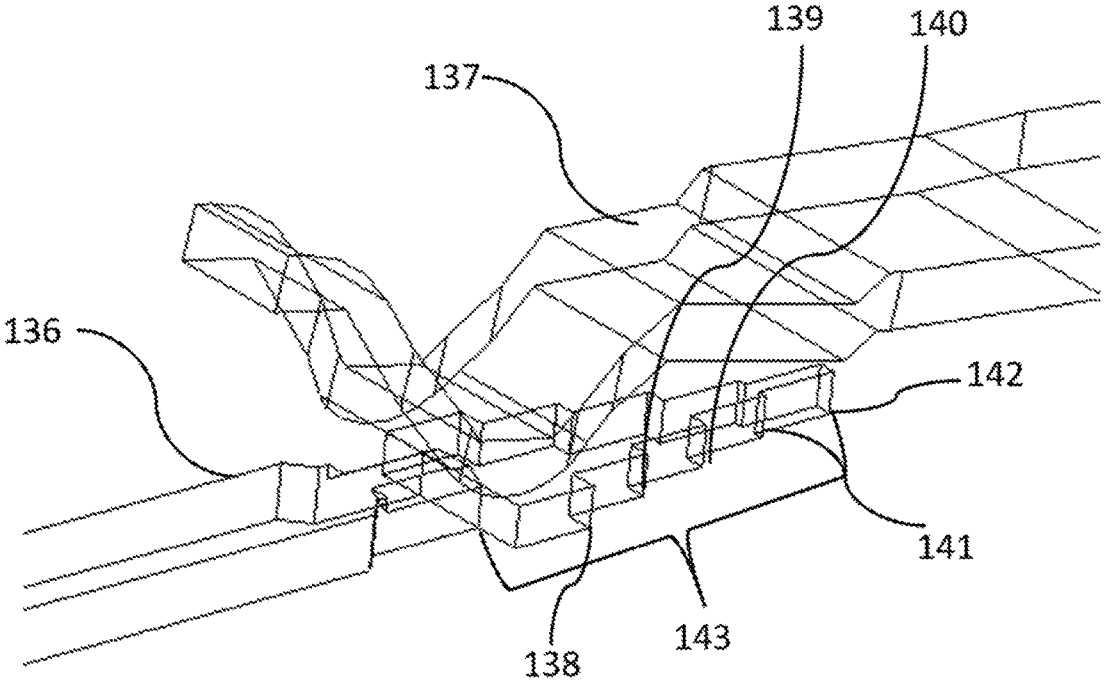
FIG. 10 illustrates an example implementation of a connector with varying-impedance stub, in accordance with an example implementation.

FIG. 10 illustrates another example implementation of a connector with stub, in accordance with an example implementation. 136 is the plug of a connector. 137 is the receptacle of a connector. Specifically, FIG. 10 illustrates an example of a variable-impedance connector stub design. 138 is a section having a larger width than the section 139. 139 is the section with a larger width than the section at 140. 140 is a section with a larger width than section 141. 141 is the section with a larger width then than section 142. Section 138 is a section having the largest width of the connector stub of FIG. 10, thereby having lower impedance. Accordingly, the impedance of sections 138, 139, 140, 141, and 142 gradually increase with gradual width reduction. Collectively, section 138, 139, 140, 141, and 142 with increasing impedance form the connector stub 144.

Figure 11:
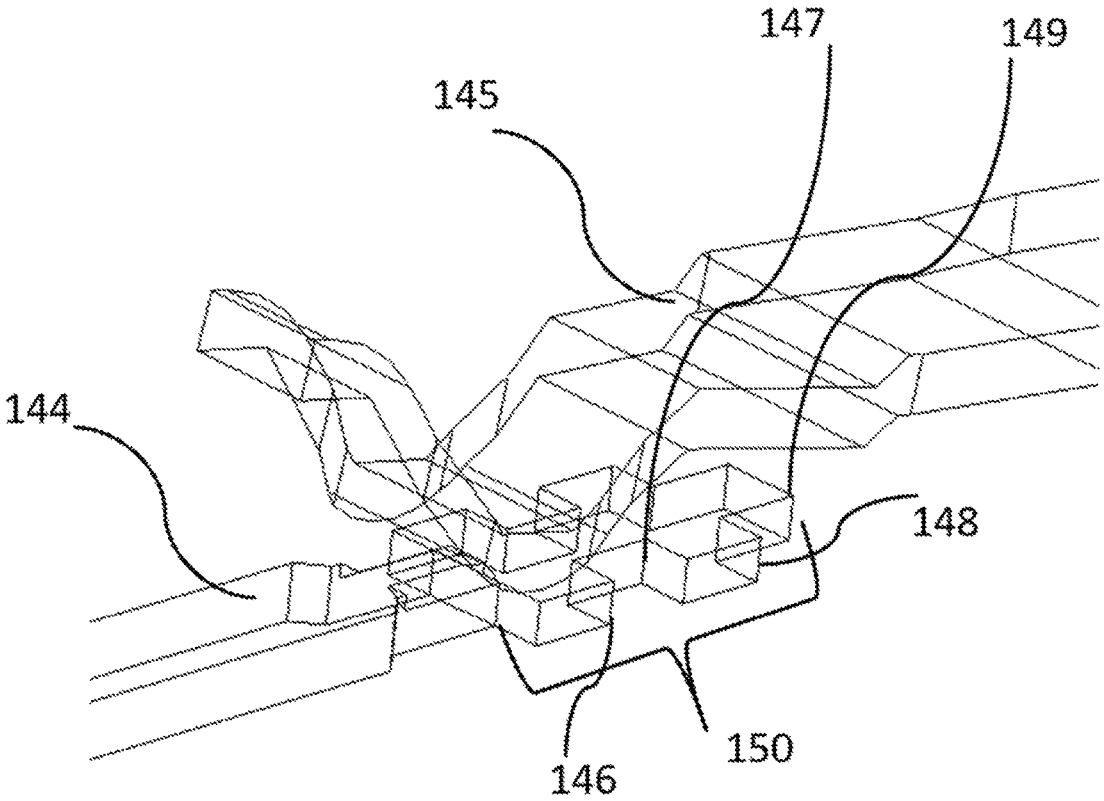
FIG. 11 illustrates another example implementation of a connector with varying-impedance stub, in accordance with an example implementation.

FIG. 11 illustrates another example implementation of a connector with stub, in accordance with an example implementation. 144 is the plug of a connector. Specifically, FIG. 11 illustrates an example of a varying-impedance connector stub design. 145 is the receptacle of a connector. 146 is the section with larger width for low impedance. 147 is the section with smaller width for high impedance. 148 is the section with larger width for low impedance. 149 is the section with smaller width for high impedance. Collectively, low impedance section 146 to high impedance section 147 to low impedance section 148 to high impedance section 149 forms the connector stub 150.

Although the above examples are directed to forming the low-then-high impedance structure through modification of the widths of sections from the original connector stub, other implementations are also possible to create the low-then-high impedance structure, and the present disclosure is not limited thereto.

Similarly, other implementations are also possible to modify the total capacitance of the connector stub from an original connector stub, and the present disclosure is not limited thereto to reshaping the connector stub. One of ordinary skill in the art can utilize any desired means to reduce the total capacitance of a connector stub to facilitate the shift in resonance frequency to be higher.

Although example implementations described herein are directed to a connector stub, other implementations that operate at high signal frequency and need mitigation for insertion loss are also possible and the present disclosure is not limited thereto. For example, PCB via stubs may also be divided into sections with varying impedance to shift the resonance frequency higher.

Moreover, other implementations of the present application will be apparent to those skilled in the art from consideration of the specification and practice of the teachings of the present application. Various aspects and/or components of the described example implementations may be used singly or in any combination. It is intended that the specification and example implementations be considered as examples only, with the true scope and spirit of the present application being indicated by the following claims.

What is claimed is:

1. A method of mitigating connector stub resonance, the method comprising:

shifting resonant frequency of a connector stub to be higher than an original resonant frequency of the connector stub; and modifying a characteristic impedance of the connector stub such that input impedance of the connector stub becomes capacitive at the original resonant frequency.

2. The method of claim 1, wherein the connector stub comprises a plurality of segments, wherein at least one of the plurality of segments has a different width or impedance than another one of the plurality of segments.

3. The method of claim 1, wherein the connector stub comprises a continuously shaped structure having a low-then-high impedance structure from a plug portion of the connector stub to an end of the connector stub.

4. The method of claim 1, further comprising reshaping the connector stub such that the connector stub has a total capacitance that is equal to or less than the total capacitance of the original stub.

5. The method of claim 1, further comprising reshaping the connector stub such that the connector stub has a total area that is equal to or less than the total area of the original stub.

6. A connector plug, comprising:

a connector stub reshaped from an original connector stub, the connector stub configured to engage with a receptacle, the connector stub comprising a first section and a second section, the first section configured to be in closer proximity to an entrance of the receptacle than the second section when the connector stub engages the receptacle, the second section disposed towards a plug end of the connector plug;

wherein the first section has a smaller impedance than the second section, wherein at least one of:

a) capacitance of the connector plug stub, and b) total area of the connector plug stub is made to be equal to or less than the original connector plug stub.

7. The connector plug of claim 6, wherein the first section has a larger width than the second section.

8. The connector plug of claim 6, wherein the first section comprises a plurality of low-then-high impedance structures.

9. The connector plug of claim 8, wherein the second section comprises a plurality of low-then-high impedance structures.

10. The method of claim 1, wherein the connector stub comprises a continuously shaped structure having a low-then-high impedance structure from a receptacle portion of the connector stub to an end of the connector stub.

11. A connector receptacle, comprising:

a connector stub reshaped from an original connector stub, the connector stub configured to engage with a plug, the connector stub comprising a first section and a second section, the first section configured to be in closer proximity to a larger width section of a plug than the second section when the connector receptacle engages the plug, the second section is situated away from the end of the connector plug;

wherein the first section has a smaller impedance than the second section, wherein at least one of:

a) capacitance of the connector receptacle stub, and b) total area of the connector receptacle stub is made to be equal to or less than the original connector stub.

12. The connector receptacle of claim 11, wherein the first section has a larger width than the second section.

13. The connector receptacle of claim 11 wherein the first section comprises a plurality of low-then-high impedance structures.

14. The connector receptacle of claim 13, wherein the second section comprises a plurality of low-then-high impedance structures.

* * * * *